US009878457B2

(12) United States Patent
Kulshreshtha

(10) Patent No.: US 9,878,457 B2
(45) Date of Patent: Jan. 30, 2018

(54) ELECTRIC HAIR CLIPPER

(71) Applicant: SKULL SHAVER, LLC, Moorestown, NJ (US)

(72) Inventor: Neel B. Kulshreshtha, Burlington Township, NJ (US)

(73) Assignee: Skull Shaver, LLC, Moorestown, NJ (US)

( * ) Notice: Subject to any disclaimer, the term of this patent is extended or adjusted under 35 U.S.C. 154(b) by 259 days.

(21) Appl. No.: 13/962,149

(22) Filed: Aug. 8, 2013

(65) Prior Publication Data

US 2015/0040405 A1 Feb. 12, 2015

(51) Int. Cl.
*B26B 19/28* (2006.01)
*B26B 19/38* (2006.01)
*B26B 19/06* (2006.01)

(52) U.S. Cl.
CPC ..... *B26B 19/28* (2013.01); *B26B 19/06* (2013.01); *B26B 19/3853* (2013.01)

(58) Field of Classification Search
CPC ..... B26B 19/3853; B26B 19/28
USPC ..... 30/526, 527
See application file for complete search history.

(56) References Cited

U.S. PATENT DOCUMENTS 1,201,317 A * 10/1916 Lishawa ..... 30/74.1
2,060,520 A * 11/1936 Muros ..... 30/60.5
2,102,142 A * 12/1937 Burnett ..... 30/41
2,108,758 A * 2/1938 Emerson et al. ..... 30/64
2,648,129 A * 8/1953 Streeter ..... 30/74.1
2,720,696 A * 10/1955 Wadsworth ..... 30/41.5
2,835,030 A * 5/1958 Seller ..... 30/60.5
3,045,342 A * 7/1962 Diehl ..... 30/32
3,314,146 A * 4/1967 Cooksey ..... 30/43.6
4,177,698 A * 12/1979 Greneker ..... 81/177.3
4,709,475 A * 12/1987 Phung ..... 30/31
D304,773 S * 11/1989 Beuchat ..... D28/46
5,009,003 A * 4/1991 Grange ..... 30/30
5,031,319 A * 7/1991 Althaus et al. ..... 30/526
5,038,479 A * 8/1991 Davis ..... 30/298
5,520,616 A * 5/1996 Hofmeister ..... 601/74
6,018,877 A * 2/2000 Greene ..... 30/526
6,029,356 A * 2/2000 Sprinkle ..... 30/298
D426,918 S * 6/2000 Greene ..... D28/48
6,112,421 A 9/2000 Greene
D444,915 S * 7/2001 Bianco ..... D28/45
D446,351 S 8/2001 Greene
6,308,416 B1 * 10/2001 Bosy et al. ..... 30/50
6,493,950 B1 * 12/2002 Kludjian et al. ..... 30/526
D528,701 S 9/2006 Oh (Continued)

*Primary Examiner* — Sean Michalski
(74) *Attorney, Agent, or Firm* — Norman E. Lehrer

(57) ABSTRACT

An electric hair clipper includes a housing containing an electrical source and drive-related components. A clipper mechanism having a reciprocating clipper is located beneath the bottom of the housing but is spaced therefrom by a central hub that extends downwardly from the bottom of the housing. The housing, central hub and clipper mechanism are arranged such that a person can hold the electric hair clipper by placing his or her fingers in the space between the housing and the clipper mechanism with the central hub lying between two fingers and with the back of the person's fingers resting in a pair of elongated spaced apart recesses formed in the bottom of the housing on opposite sides of the hub.

3 Claims, 3 Drawing Sheets

(56) References Cited

U.S. PATENT DOCUMENTS

| | | | | |
|---|---|---|---|---|
| D558,924 | S | 1/2008 | Cafaro et al. | |
| D601,301 | S * | 9/2009 | Bao | D28/50 |
| D663,897 | S | 7/2012 | Aulwes et al. | |
| D663,898 | S * | 7/2012 | Aulwes et al. | D28/54 |
| 8,393,082 | B2 * | 3/2013 | Shimizu | 30/43.6 |
| 8,782,911 | B1 * | 7/2014 | Greene | 30/526 |
| D710,542 | S * | 8/2014 | Eagleton et al. | D28/48 |
| 2002/0083600 | A1 * | 7/2002 | Donovan | 30/526 |
| 2003/0033717 | A1 * | 2/2003 | Cecil | 30/50 |
| 2003/0084573 | A1 * | 5/2003 | Kludjian et al. | 30/50 |
| 2003/0167644 | A1 * | 9/2003 | Motta et al. | 30/526 |
| 2008/0034591 | A1 * | 2/2008 | Fung | 30/43.92 |
| 2008/0072430 | A1 * | 3/2008 | Cafaro et al. | 30/45 |
| 2008/0155834 | A1 * | 7/2008 | Li et al. | 30/210 |
| 2009/0025234 | A1 | 1/2009 | Carlucci | |
| 2010/0287784 | A1 * | 11/2010 | Qiu | 30/527 |
| 2011/0167653 | A1 * | 7/2011 | Psimadas et al. | 30/526 |
| 2011/0308087 | A1 * | 12/2011 | Rehbein et al. | 30/34.1 |
| 2012/0090181 | A1 * | 4/2012 | Broekhuizen et al. | 30/123 |
| 2012/0110855 | A1 * | 5/2012 | Allen, Sr. | 30/43.6 |
| 2012/0124846 | A1 * | 5/2012 | Hopfner et al. | 30/526 |
| 2012/0159795 | A1 * | 6/2012 | Walmsley | 30/526 |
| 2012/0279073 | A1 * | 11/2012 | Snow et al. | 30/295 |
| 2013/0031794 | A1 * | 2/2013 | Duff et al. | 30/526 |
| 2013/0212885 | A1 * | 8/2013 | Lyles | 30/42 |
| 2013/0255455 | A1 * | 10/2013 | McCue | 83/13 |
| 2015/0089814 | A1 * | 4/2015 | Marut | 30/42 |

* cited by examiner

ELECTRIC HAIR CLIPPER

BACKGROUND OF THE INVENTION

The present invention is directed toward electric hair clippers or trimmers and, more particularly, toward electric hair clippers that allow a person to trim his or her own hair in areas such as the back of the neck that are otherwise difficult to do with conventional clippers.

Electric hair clippers generally include a hand-held housing that contains a motor and power supply-related components that drive a reciprocating trimming blade. The housing also provides a form that fits the user's hand sufficiently as a grip so as to allow the user to manipulate the hair clipper. Various types of clippers are well known in the art. In general, the clippers comprise an elongated housing with a reciprocating trimming blade at one end with the blade being perpendicular to the axis of the housing. While such conventional clippers are relatively easy to manipulate when trimming another person's hair, they are awkward to use on one's own hair and particularly the back of one's neck.

There is, therefore, a need for an electric hair clipper that allows a person to trim his or her own hair in areas such as the back of the neck that are otherwise difficult to do with conventional clippers.

SUMMARY OF THE INVENTION

The present disclosure relates to an electric hair clipper that includes a housing containing an electrical source and drive-related components. A clipper mechanism having a reciprocating clipper is located beneath the bottom of the housing but is spaced therefrom by a central hub that extends downwardly from the bottom of the housing. The housing, central hub and clipper mechanism are arranged such that a person can hold the electric hair clipper by placing his or her fingers in the space between the housing and the clipper mechanism with the central hub lying between two fingers and with the back of the person's fingers resting in a pair of elongated spaced apart recesses formed in the bottom of the housing on opposite sides of the hub.

When the electric hair clipper of the present invention is held in the above described manner, it is possible to easily either grip the hair clipper with two fingers as between the thumb and index finger, or between the index and middle fingers and properly orient cutting clipper. This allows the person to easily trim areas such as the back of the neck that are otherwise difficult to do.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
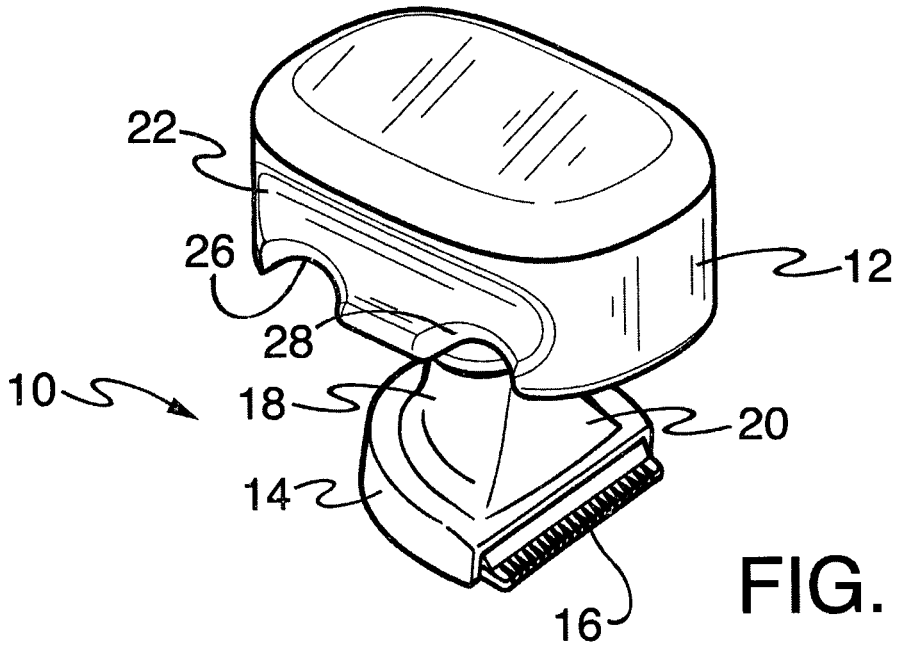
FIG. 1 is a top perspective view of an electric hair clipper in accordance with the invention.
Figure 2:
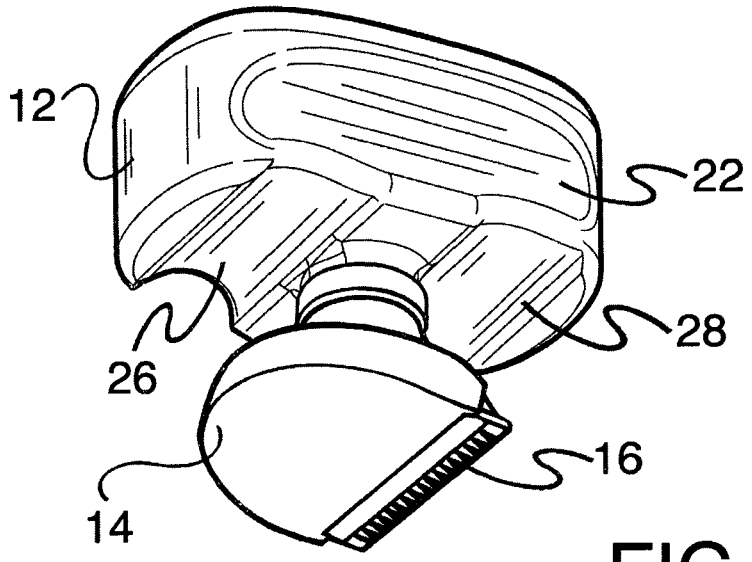
FIG. 2 is a bottom perspective view thereof.
Figure 3:
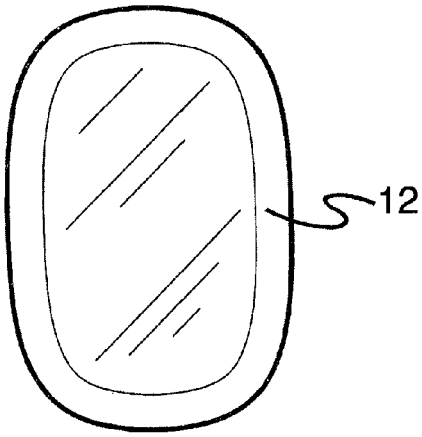
FIG. 3 is a top plan view thereof.
Figure 4:
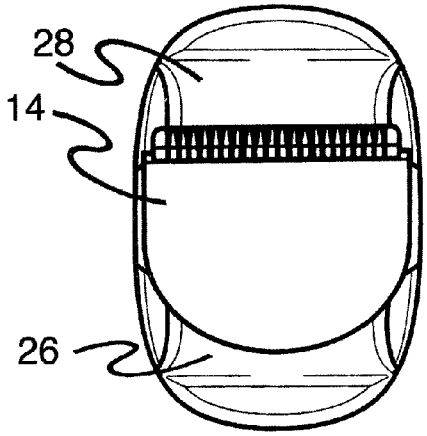
FIG. 4 is a bottom plan view thereof.

A more complete understanding of the components, processes, and apparatuses disclosed herein can be obtained by reference to the accompanying figures. These figures are intended to demonstrate the present disclosure and are not intended to show relative sizes and dimensions or to limit the scope of the exemplary embodiments.

Although specific terms are used in the following description, these terms are intended to refer only to particular structures in the drawings and are not intended to limit the scope of the present disclosure. It is to be understood that like numeric designations refer to components of like function.

In one embodiment, the present disclosure relates to a hair clipper that comprises a gripping means and a cutting clipper or trimmer, configured in such a manner that allows the hair clipper to be oriented with the grip portion above the cutter portion with space between them for a persons fingers, thus making it anatomically convenient to hold the hair clipper and trim one's own hair.

Referring now to the drawings in detail wherein like reference numerals have been used throughout the various figures to designate like elements, there is shown in FIGS. 1-8 an electric hair clipper or trimmer constructed in accordance with the principles of the present invention and designated generally as 10.

Figure 5:
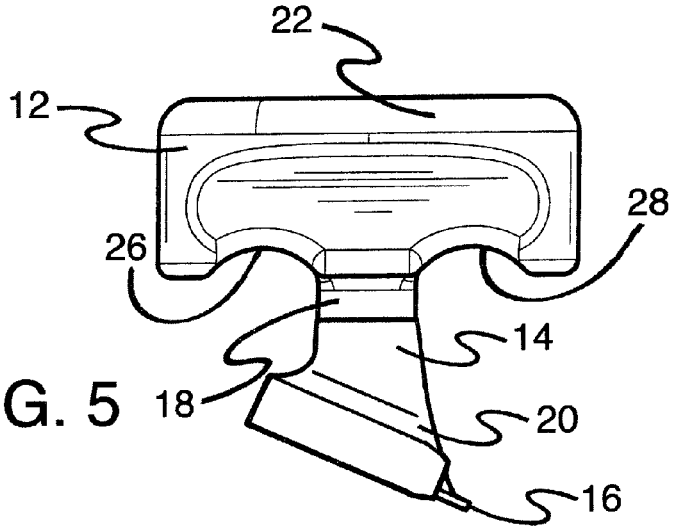
FIG. 5 is a left side elevational view thereof, the right side being the mirror image thereof.
Figure 6:
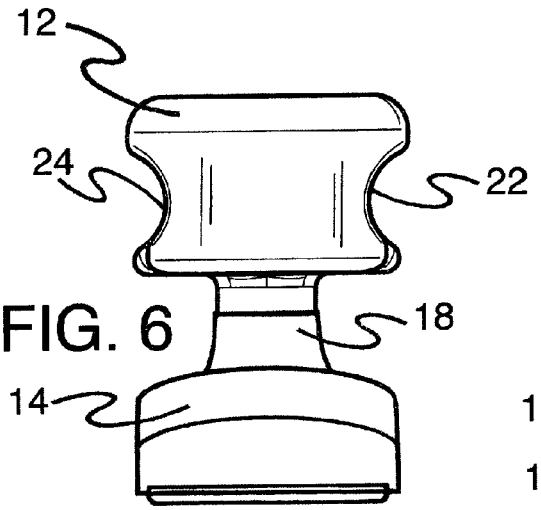
FIG. 6 is a rear elevational view thereof.
Figure 7:
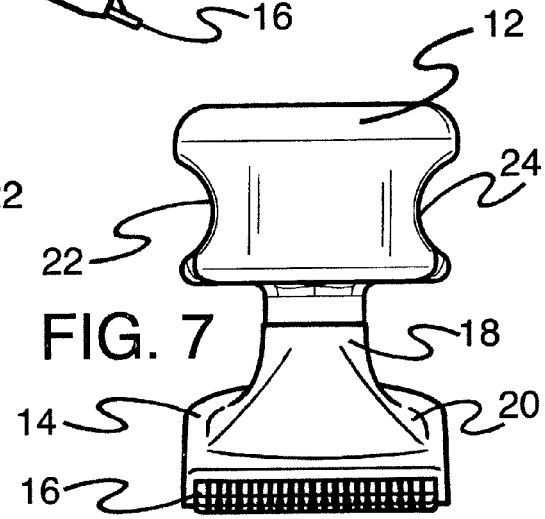
FIG. 7 is a front elevational view thereof.
Figure 8:
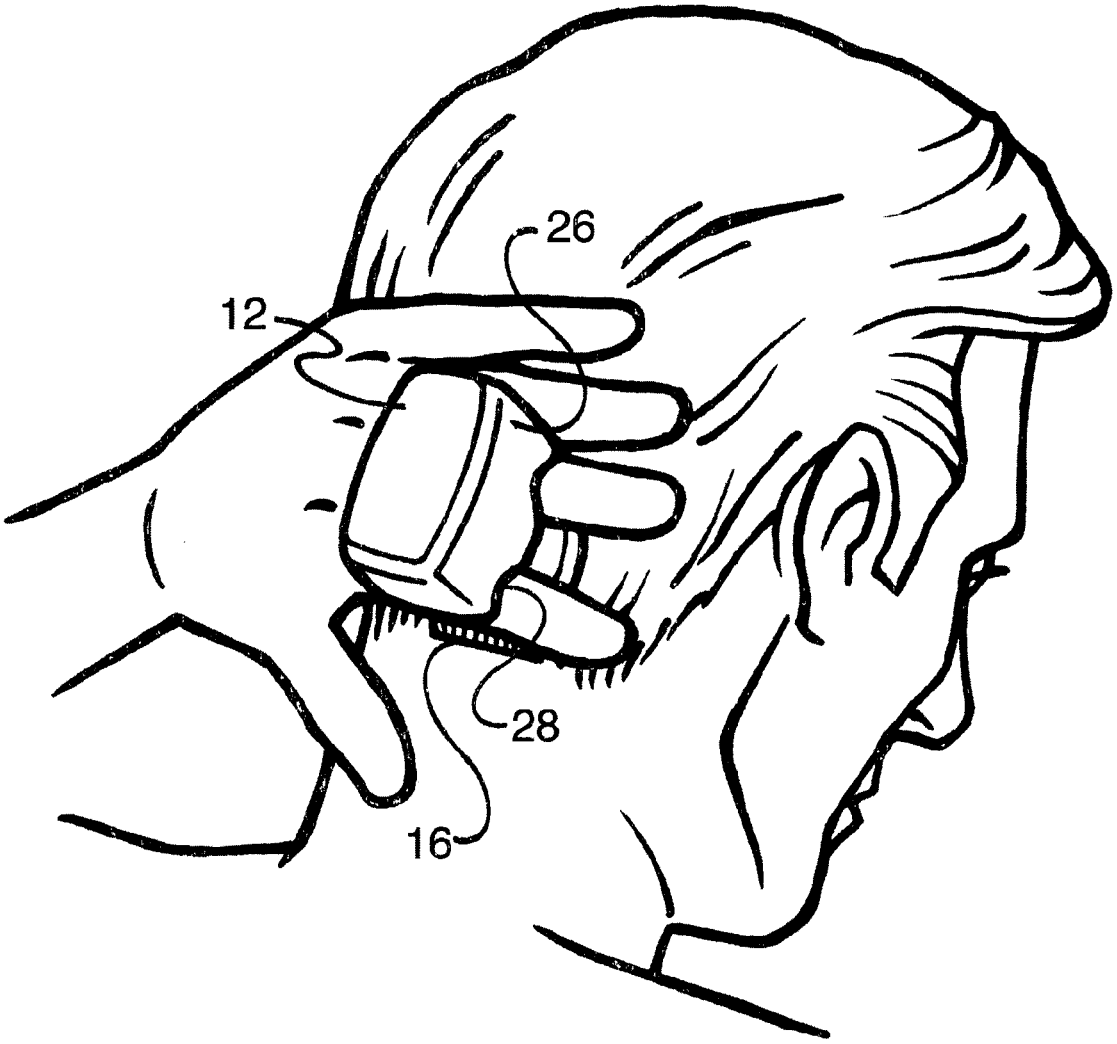
FIG. 8 is a perspective view showing how the electric clipper of the invention is held and used to trim one's hair.

The hair clipper 10 comprises an upper portion 12 that provides a substantially rectangularly shaped housing for a power source and motor related components, and a trimmer mechanism 14 that includes a reciprocating straight line trimmer 16. The connection between the motor and the trimmer head passes through the central hub 18 which may have an enlarged lower portion 20. The straight line trimmer 16 is, per se, conventional and is well known in the art. As shown in the figures and as is known in the art, the distal edge of the trimmer 16 (as shown at the right of FIG. 5 and the bottom of FIG. 6, for example) defines a straight line. The motor (not shown) is also mechanically coupled to the trimmer 16 in a known manner.

The motor, power supply and other related components along with the trimmer are not, per se, part of the present inventive concept. They are all individually common and well known in the art. Accordingly, detailed descriptions of the same are not believed to be necessary.

The housing 12 further comprises a particular form that provides a gripping means, and fits the hand in a comfortable manner. The gripping means includes a pair of elongated recesses in the form of parallel concave surfaces 22 and 24 formed on either side of the housing 12. The concave surfaces define a plane that is parallel to the line formed by the trimmer 16. A second pair of elongated recesses in the form of concave surfaces 26 and 28 are formed in the under surface of the housing 12 above the trimmer 16. The second pair of concave surfaces 26 and 28 are arranged to be perpendicular to the first pair of concave surfaces 22 and 24 and also define a plane that is parallel to the line defined by the trimmer 16.

Concave surfaces 22 and 24 are configured to allow the hair clipper 10 to be gripped between the thumb and tips of several of one's remaining fingers with the palm of one's hand overlying the housing 12. Holding the trimmer 10 in this manner will allow the user to trim sideburns or other easy to reach facial hairs. However, when it is desired to trim harder to reach areas such as the back of one's neck, the clipper 10 is held in the manner shown in FIG. 8.

As shown, the person places his or her fingers in the space between the housing 12 and the clipper mechanism 14 with the central hub 18 lying between two fingers and with the back of the person's fingers resting in the concave recesses or grooves 26 and 28. The person's fingers are also gripping the central hub 18. When the clipper is held in this manner, it can be seen that the clipper or trimmer 16 is in line with the person's fingers making it easy for the person to trim the back of his or her neck.

The present disclosure has been described with reference to an exemplary embodiment. Obviously, modifications and alterations will occur to others upon reading and understanding the preceding detailed description. It is intended that the present disclosure be construed as including all such modifications and alterations insofar as they come within the scope of the appended claims or the equivalents thereof.

I claim:

1. An electric hair clipper comprising:

a housing for containing an electrical source and electric motor drive-related components, said housing including two substantially opposed and substantially parallel sides and a bottom;

a clipper mechanism located beneath said bottom of said housing and spaced therefrom;

a central hub extending from said bottom of said housing to said clipper mechanism and connecting said clipper mechanism to said housing;

said clipper mechanism including a reciprocating clipper having a distal edge defining a line;

a first pair of elongated open channels formed on said sides of said housing, said first pair of elongated open channels being substantially parallel to each other and lying in a plane that is spaced apart from the line of said clipper, and a second set of elongated spaced apart open channels formed in said bottom of said housing, the channels of said second set being located on opposite sides of said hub and extending perpendicular to said first pair of channels.

2. The electric hair clipper as claimed in claim 1 wherein each of said channels is defined by a concave surface adapted to accommodate a portion of a user's fingers therein.

3. An electric hair clipper comprising:

a housing for containing an electrical source and electric motor drive-related components, said housing having a top surface and a bottom surface;

a clipper mechanism located beneath said bottom surface of said housing and spaced therefrom, said clipper mechanism including a reciprocating clipper having a distal edge defining a straight line;

a central hub having an upper portion connected to and extending downwardly from said bottom surface of said housing, said central hub having a lower portion connected to said clipper mechanism, and a pair of elongated spaced apart open channels formed in said bottom surface of said housing and being located on opposite sides of said central hub, said housing, central hub and clipper mechanism being arranged such that a person can hold the electric hair clipper by placing his or her fingers in the space between said housing and said clipper mechanism with the central hub lying between two fingers and with the back of said person's fingers resting in said channels.

* * * * *